US005378960A

United States Patent [19]

Tasker et al.

[11] Patent Number: 5,378,960

[45] Date of Patent: Jan. 3, 1995

[54] THIN FILM CONTINUOUS DYNODES FOR ELECTRON MULTIPLICATION

[75] Inventors: G. William Tasker, West Brookfield, Mass.; Jerry R. Horton, Cape Elizabeth, Me.

[73] Assignee: Galileo Electro-Optics Corporation, Sturbridge, Mass.

[21] Appl. No.: 89,771

[22] Filed: Jul. 12, 1993

Related U.S. Application Data

[63] Continuation of Ser. No. 395,588, Aug. 18, 1989, abandoned.

[51] Int. Cl.[6] ..... H01J 43/04

[52] U.S. Cl. ..... 313/103 CM; 313/105 CM; 313/104; 313/534

[58] Field of Search ..... 313/103 CM, 105 CM, 313/103, 104, 534

[56] References Cited

U.S. PATENT DOCUMENTS

| | | | |
|---|---|---|---|
| Re. 31,847 | 3/1985 | Luckey . | |
| 2,841,729 | 7/1958 | Wiley | 313/104 |
| 3,244,922 | 4/1966 | Wolfgang | 313/103 X |
| 3,488,509 | 1/1970 | Goodrich | 313/103 CM |
| 3,675,063 | 7/1972 | Spindt et al. . | |
| 3,959,038 | 5/1976 | Gutierrez et al. . | |
| 3,976,905 | 8/1976 | Seidman et al. | 313/105 CM |
| 4,015,159 | 3/1977 | Zipfel, Jr. . | |
| 4,051,403 | 9/1977 | Feingold et al. . | |
| 4,093,562 | 6/1978 | Kishimoto . | |
| 4,095,132 | 6/1978 | Fraioli . | |
| 4,095,136 | 6/1978 | Niklas | 313/105 CM |
| 4,099,079 | 7/1978 | Knapp | 313/103 CM |
| 4,236,073 | 11/1980 | Martin . | |
| 4,352,985 | 10/1982 | Martin . | |
| 4,454,422 | 6/1984 | Persyk . | |
| 4,468,420 | 8/1984 | Kawahara et al. . | |
| 4,558,144 | 12/1985 | Fay et al. . | |
| 4,563,250 | 1/1986 | Becker et al. . | |
| 4,577,133 | 3/1986 | Wilson . | |
| 4,757,229 | 7/1988 | Schmidt et al. . | |
| 4,780,395 | 10/1988 | Saito et al. . | |
| 4,800,263 | 1/1989 | Dillon et al. . | |
| 4,825,118 | 4/1989 | Kyushima . . | |

FOREIGN PATENT DOCUMENTS

| | | | |
|---|---|---|---|
| 1121858 | 4/1982 | Canada | 313/103 CM |
| 2180986 | 4/1987 | United Kingdom . | |

OTHER PUBLICATIONS

G. E. Hill, "Secondary Electron Emission and Compositional Studies on Channal Plate Glass Surfaces", pp. 153–165 in Advances in Electronics and Electron Physica (vol. 40A) edited by L. Martin, Academic, London (1976).

A. M. Tyutikov et al., "Study of the Surface Layer Composition and the Secondary Electron Emission Coefficient of Lead Silicate Glass", Sov. J. Opt. Technol., 47 [4] 201–3 (1980) Apr.

Ju. M. Simeonova et al., "Surface Compositional Studies of Heat Reduced Lead Silicate Glass", J. Non--Cryst. Solids, 57 177–87 (1983) Mar.

N. R. Whetten, "Secondary Electron Emission", pp. 69–84 in Methods of Experimental Physics (vol. 4), Academic, New York (1964).

R. U. Martinelli et al., "The Application of Semiconductors with Negative Electron Affinity to Electron Emission Devices", Proc. IEEE, 62 [10] 1339–60 (1974) Oct.

(List continued on next page.)

*Primary Examiner*—Michael Horabik

*Attorney, Agent, or Firm*—Watson, Cole, Grindle & Watson

[57] ABSTRACT

A continuous thin film dynode includes a substrate with at least one channel having a channel wall, an isolation layer overlying the channel wall, and a thin film overlying the isolation layer. The thin film includes a current carrying portion and an electron emissive portion overlying the current carrying portion. The electron emissive portion is essentially free of a material which is silica-rich, alkali-rich, and lead-poor. The current carrying portion is essentially free of a material which is lead-rich.

37 Claims, 7 Drawing Sheets

OTHER PUBLICATIONS

W. Kern et al., "Chemical Vapor Deposition of Inorganic Thin Films", pp. 257–331 in Thin Film Processes, edited by J. L. Vossen and W. Kern, Academic, New York (1978).

P. D. Dapkus, "Metalorganic Chemical Vapor Deposition", Ann Rev. Mater. Sci., 12 243–69 (1982).

A. C. Adams, "Dielectric and Polysilicon Film Deposition", pp. 93–129 in VLSI Technology, edited by S. M. Sze, McGraw-Hill, N.Y. (1983).

M. L. Green et al., "Chemical Vapor Deposition of Metals for Integrated Circuit Applications", J. Metals, Jun. 63–71 (1985).

S. Wolf et al., Silicon Processing for the VSLI Era (vol. 1–Process Technology), Chapters 5–7, Lattice Press, Sunset Beach, Calif. (1986).

D. P. Stinton et al., "Advanced Ceramics by Chemical Vapor Deposition Techniques", Ceram. Bull., 67 [2] 350–5 (1988).

J. R. Hollahan et al., "Plasma Deposition of Inorganic Thin Films", pp. 335–360 in Thin Film Processes, edited by J. L. Vossen and W. Kern, Academic, New York (1978).

P. K. Backmann et al., "Plasma-Assisted Chemical Vapor Deposition Processes", MRS Bull., pp. 52–59, Dec. (1988).

M. J. Mayo, "Photodeposition: Enhancement of Depositionn Reactions by Heat and Light", Solid State Technol., Apr. 141–4 (1986).

C. G. Pantano et al., "Electron Beam Damage in Auger Electron Spectroscopy", Appl. Surf. Sci., 7 115–41 (1981).

W. B. Feller et al., "Low Noise Microchannel Plates", Proc. SPIE 1072 (1989) Jan.

G. W. Goodrich et al., "Resistance Strip Magnetic Electron Multiplier", Rev. Sci. Instr., 32 [7] 846–9 (1961) Jul.

R. H. Sokol et al., "Characterization of Single Channel Electron Multipliers", The Mass Spec Source, 11 [2] 27–9 (1988) Aug.

K. Oba et al., "An Analysis of the Direct Current Operation of Channel Electron Multipliers", pp. 183–205 in Advanced in Electronics and Electron Physics, Academic, London (1972).

H. Becker et al., "Preparation and Characteristics of a Channel Electron Multiplier", Rev. Sci. Instr., 43 [11¼ 1587–9 (1972) Nov.

Y. Sakai et al., "Study of the Fatigue Mechanism in Channel Electron Multipliers", Surf. Sci., 86 359–68 (1979).

A. A. Manalio et al., "More Efficient Channel Electron Multiplier by Coating of the Cone with a High Secondary Electron Yield Material", Rev. Sci. Instrum., 52 [10] 1490–2 (1981) Jun.

Harbeke et al., "LPCVD Polycrystalline Silicon: Growth and Physical Properties of In-Situ Phosphorous Doped and Undoped Flims", RCA Rev., 44 Jun. 287–312 (1983).

S. M. Sze, "Physics of Semiconductor Devices", Appendices H & I, Wiley-Interscience, New York (1981).

R. V. Prasad et al., "Semi-Insulating Polysilicon: Growth Processing and Structures Characterization", Mater. Lett. 4 [2]71–6 (1986) Feb.

R. S. Ehle et al., "Low Temperature Alumina Oxide Deposition Using Trimethylaluminum", J. Electronic Mat., 12 [3] 587–601 (1983).

Iwase et al., "Alumina Nitride Substrates Having High Thermal Conductivity", Solid State Technol., Oct. 135–8 (1986).

Nagayama et al., "A New Process for Silica Coating", J. Electrochemical Society, vol. 135, [8] (1988). Aug.

Eschard et al., "Principle and Characteristics of Channel Electron Multipliers", Acta Electronica [14] pp. 19–39 (1971).

P. H. Dawson, "Secondary Electron Yields of Some Ceramics", J. App. Phys., 37 [9] 364–5 (1966) Feb.

Elements of Material Science and Engineering, L. H. Van Vlack (Addison-Wesley, Reading, Mass. 1980).

"The Parallel-Plate Electron Multiplier", L. P. Anderson et al. J. Phys. E. Sci. Instrum. 1979, pp. 1015–1022.

"Study of Electric Field Inside Microchannel Plate Multipliers" E. Gatti et al., 1983 IEEE.

Rajopadhye, N. R. et al., "Characterization of $Al_2O_3$ Films Deposited by Various Methods", Thin Solid Films, Preparation and Characterization, 142, pp. 127–138 (1986) Feb.

Then, A. M. et al., "Formation and Behavior of Surface Layers on Electron Emission Glasses", Journal of Non-Crystalline Solids, 120, pp. 178–187, North-Holland (1990).

Whetten, N. Rey et al., "Secondary Electron Emission from MgO Thin Films", Journal of Applied Physics, vol. 30, No. 3, pp. 432–435 (Mar., 1959).

M. Lampton, "The Microchannel Image Intensifier", Scientific American, 245 [5] 62–71 (1981) Nov.

D. Washington et al., "Technology of Channel Plate Manufacture", Acta Electronica, 14 [2] 201–24 (1971).

H. J. L. Trap, "Electrical Conductivity in Oxide Glasses", Acta Electronica, 14 [1] 41–77 (1971).

THIN FILM CONTINUOUS DYNODES FOR ELECTRON MULTIPLICATION

This is a continuation application Ser. No. 395,588, filed Aug. 18, 1989, now abandoned.

BACKGROUND OF THE INVENTION

Channel electron multipliers 10 (CEMs) (FIG. 1) and microchannel plates 20 (MCPs) (FIG. 2) are efficient, low-noise, vacuum-electron amplifiers with typical gains $(G)=I_o/I_i$ in the range of $10^3$–$10^8$ where $I_o/I_i$ is the ratio of the output to input currents. CEMs 10 are devices which have a single channel 12 and are generally used for direct detection of charged particles (e.g., electrons and ions) and photons from soft X-ray to extreme ultraviolet wavelengths (i.e., 1–100 nm). They are mainly used as detectors in a wide variety of scientific instrumentation for mass spectrometry, electron spectroscopy for surface analysis, electron microscopy, and vacuum ultraviolet and X-ray spectroscopy.

MCPs 20 are fabricated as areal arrays of millions of essentially independent channel electron multipliers which operate simultaneously and in parallel. Using an MCP, direct detection of charged particles and sufficiently energetic electromagnetic radiation can be achieved in two dimensions over large areas (up to several hundred $cm^2$) with good resolution (channel spacing or pitch $<0$ $\mu m$) at fast response times (output pulse widths $<300$ ps), and with linear response over a broad range of input even levels ($10^{-12}$–$10^{-1}$A). By placing an MCP between a suitable photocathode and fluorescent screen in an optical image tube (not shown), two-dimensional signals from the ultraviolet to the near-infrared spectral region can be intensified and displayed as a visible image. While MCPs continue to find major application in image tubes for military night-vision systems, there is now growing interest in MCPs for high-performance commercial applications as well. These presently include high-speed and high-resolution cameras, high-brightness displays, and state-of-the-art detectors for scientific instrumentation.

CEMs and MCPs essentially consist of hollow, usually cylindrical channels. When operated at pressures $\leqq 1.3\times10^{-4}$ Pa ($10^{-6}$ torr) and biased by an external power supply, such channels support the generation of large electron avalanches in response to a suitable input signal. The cutaway view of FIG. 1 shows CEM 10 in operation. The process of electron multiplication in a straight channel does not critically depend on either the absolute diameter (D) or length (L) of the channel, but rather on the L/D ratio ($\alpha$). For a curved channel, the ratio ($\beta$) of the channel length L to the radius of channel curvature (S), L/S, is the important parameter. These geometric ratios largely determine the number of multiplication events (n) that contribute to the electron avalanche. Typical values of $\alpha$ range from 30 to 80 for conventional CEMs and MCPs with channel diameters D on the scale of 1 mm and 10 $\mu m$, respectively. Thus, a CEM 10 is a single channel electron multiplier of macroscopic dimensions while MCP 20 is a wafer-thin array of microscopic electron multipliers with channel densities of $10^5$–$10^7/cm^2$.

The channel wall 14 of CEM 10 or the wall 24 of the MCP 20 acts as a continuous dynode for electron multiplication and may be contrasted with the operation of photoemissive detectors using discrete dynodes (e.g., an ordinary photomultiplier tube). In operation, the continuous dynodes 14 and 24 must be sufficiently resistive to support a biasing electric field $(\epsilon)=10^2$–$10^5$ V/cm without drawing an excessive current. They must also be conductive enough such that a discharging current is available to replenish electrons emitted from the dynode 14,24 during an electron avalanche. For example, when a signal event 30 such as an electrically charged particle (FIG. 1) (e.g., an electron or a $Ne^+$ ion) or sufficiently energetic radiation (e.g., an X-ray photon) strikes the channel wall 14 near the negatively biased input end 32, there is a good probability that electrons 34 will be ejected from the surface 14. These primary electrons 34 are accelerated down the channel 12 by an applied electric field $\epsilon$ (see arrow 36) produced by the bias potential ($V_B$) represented by the power supply 38. $\epsilon=V_B/L$, where $V_B$ in volts$\simeq$ 20–25$\alpha$ for a conventional straight-channel multiplier. Collision of the emitted electrons 34 with the channel wall 14 causes the emission of secondary electrons 40. These secondary electrons in turn act as primary electrons in subsequent collisions with the channel wall 14 which produce another generation of secondary electrons. Provided that more than one secondary electron is emitted for every incident primary electron, the secondary electron yield ($\delta$) $>1$, and n repetitions of this primary collision-secondary emission sequence in the direction of the output end 41 rapidly leads to an output electron avalanche 42 of magnitude $\delta^n$.

The near-surface region of the dynode 14 must have an average value of $\delta$ sufficiently greater than unity to support efficient multiplication of primary electrons impinging on a channel wall with energies ($E_P$) mostly in the range of 20–100 eV. For materials with good secondary electron emission properties, $\delta$initially increases with $E_P$ from $\delta<1$ to $\delta=1$ at the first crossover energy $E_P^I$, and then to $\delta>1$. Emissive materials of greatest interest for electron multipliers tend to have values of $E_P^I$ in the range of about 10 eV$\leqq E_P^I \leqq$50 eV, the smaller the better. For such materials, a linear approximation of $\delta(E_P)$ is $\delta=E_P/E_p^I$ for $E_P\leqq$100 eV. As an example, if $E_P^I=30$ eV for the continuous dynodes in conventional CEMs and MCPs, then an estimate of the range of $\delta$ for primary electrons with $E_P$=20–100 eV is $0.7\leqq\delta\leqq3.3$. Now, for a straight channel multiplier with $\alpha=40$, $V_B=1000$ V, $E_P^I=30$ eV, and a most probable initial energy $\bar{E}_S=3$ eV for a secondary electron as it emerges from the dynode surface, the electron gain G from a single input electron approximately calculated as follows:

$$G=\delta^n=\left[\frac{\bar{E}_p}{\bar{E}_p^I}\right]^n$$

$$=\left[\frac{(qV_B)^2}{(4\,\bar{E}_s\,E_p^I\,\alpha^2)}\right]^{\left(\frac{4\bar{E}_s\alpha 2}{qV_B}\right)}$$

$$=4\times10^4.$$

The most probable collision energy of the primary electrons $$(\bar{E}_P)=(qV_B)^2/4\bar{E}_S\alpha^2\simeq52\text{ eV};$$

the average yield or gain per multiplication event $$\delta=(qV_B)^2/4\bar{E}_S E_P^I \alpha^2 \simeq 1.75;$$

the number of the multiplication events $$n=4\bar{E}_S\alpha^2/qV_B \simeq 19; \text{ and,}$$

q is the magnitude of electronic charge.

When the electron avalanche emerges from the channel as an output signal, it typically represents a very large amplification of the original input signal. Because electron multiplication increases geometrically down the length of a channel, signal gains G ranging from $10^3$ to $10^8$ can be obtained depending upon the specific dynode materials, channel geometry, detector configuration, and application.

Straight-channel multipliers are limited to electron gains of about 104 due to a phenomenon known as positive ion feedback. Near the output end of a channel multiplier and above some threshold gain, residual gas molecules within the channel or gasses adsorbed on the channel wall can become ionized by interaction with the electron avalanche. In contrast to the direction of travel for electrons with negative electrical charge, positive ions are accelerated toward the negatively-biased input end of the channel. Upon striking the channel wall, these ions cause the emission of electrons which are then multiplied geometrically by the process described above. Spurious and at times regenerative output pulses associated with ion feedback can thus severely degrade the signal-to-noise characteristics of the detector.

An effective method for reducing ion feedback channel multipliers is to curve the channel. Channel curvature restricts the distance that a positive ion can migrate toward the input end of a channel, and hence greatly reduces the amplitude of spurious output pulses. Single MCPs with straight channels typically provide electron gains of $10^3$–$10^4$. Curved-channel MCPs can produce gains of $10^5$–$10^6$ but are difficult and expensive to manufacture. Curved-channel CEMs can operate at gains in excess of $10^8$.

MCPs 20 are usually fabricated with channels 22 that are inclined at an angle of ~10° relative to a normal projection from the flat parallel surfaces 26 of the device. This is done to improve the first strike efficiency of an input event. Stacking MCPs and alternating the rotational phase of the channel orientation by 180° provides another means for overcoming ion feedback in MCP detectors. Two-stage (Chevron TM) and three-stage (Z-stack) assemblies of MCPs thereby produce gains of $10^6$–$10^7$ and $10^7$–$10^8$, respectively.

The channel wall of a CEM or MCP acts as a continuous dynode for electron multiplication and may be contrasted elsewhere with the operation of detectors using discrete dynodes (e.g., an ordinary photomultiplier tube). A continuous dynode must be sufficiently conductive to replenish electrons which are emitted from its surface during an electron avalanche. In analog operation of CEMs and MCPs at a given gain G, the output current $I_o$ from a channel is linearly related to the input current providing the output does not exceed about 10% of the bias current ($i_B$), imposed by $V_B$, in the channel wall. Above a threshold input level, $I_i \sim 0.1\ i_B/G$, gain saturation occurs and current transfer characteristics are no longer linear. On the other hand, the continuous dynode must also be resistive enough to support a biasing field $\epsilon=10^2$–$10^5$ V/cm without drawing an excessive $i_B$, as manifest by thermal instability that is associated with Joule heating. Moreover, the near-surface region of the dynode must have an average value of δsufficiently greater than unity to support efficient multiplication of electrons impinging on a channel wall, as discussed above.

The electrical and electron emissive properties of continuous dynodes in the current generation of CEMs MCPs critically depend on details of their manufacture. MCPs are presently fabricated by a glass multifiber draw (GMD) process that includes drawing a rod-in-tube glass fiber of a barium borosilicate core glass clad with a lead silicate glass; stacking the composite fiber into hexagonal array and redrawing glass multifiber bundles; stacking of multifiber bundles and consolidating into billet consisting of an array of solid core glass channels imbedded in a cladding glass matrix; wafering of the billet and surface finishing; wet chemical processing to remove the core glass leaving behind an array of hollow channels extending through a wafer of cladding glass; additional wet chemical processing to enhance secondary emission from the channel surface; reducing the lead silicate glass in hydrogen atmosphere to render the dynode surface electronically conductive with a sheet resistance ($R_S$)$=10^{11}$–$10^{14}$ Ω/sq; and electroding of the flat surfaces of the MCP wafer.

Fabrication of CEMs is simpler; it entails thermal working of lead silicate glass tubing into a suitable geometry; reducing the glass in hydrogen to produce a continuous dynode surface with $R_S=10^6$–$10^8$ Ω/sq, and electroding. On account of the vastly different values of $R_S$ that are required for continuous dynodes in MCPs versus CEMs, compositionally distinct lead silicate glasses have been formulated for each application.

The hydrogen reduction step is essential to the operation of conventional electron multipliers. Lead cations in the near-surface region of the continuous glass dynode are chemically reduced in a hydrogen atmosphere at temperatures of about 350°–500° C. from the $Pb^2$ state to lower oxidation states with the evolution of $H_2O$ as a reaction product. The development of significant electronic conductivity in a region no more than about 1 μm beneath the surface of reduced lead silicate glass (RLSG) dynodes has been explained in two rather different ways. One theory holds that a small fraction (i.e., ~$10^6$) of the lead atoms within the reaction zone remains atomically dispersed in multiple valence states (i.e., $Pb^{1+}$ and $Pb^{2+}$). An electron hopping mechanism via localized electronic states in the band gap, associated with lead atoms in the multiple valence states, is said to give rise to electronic conduction. Another theory, noting that most of the lead atoms within the reaction zone are reduced to the metallic state and are agglomerated into droplet-like particles with a discontinuous morphology, suggests that electronic conduction derives from a tunneling mechanism between such particles. Regardless of the mechanism that ultimately proves correct, one can expect that the electrical characteristics of RLSG dynodes are a complex function of the chemical and thermal history of the glass surface as determined by the details of its manufacture.

During hydrogen reduction, other high-temperature processes including diffusion and evaporation of mobile chemical species in the lead silicate glass (e.g., alkali alkaline earth, and lead atoms) also act to modify the chemistry and structure of RLSG dynodes. Compositional profiles through the near-surface region of glasses that are used in the manufacture of MCPs have indicated that RLSG dynodes have a two-layer structure.

An exemplary RLSG dynode 50, shown in FIG. 3, comprises a superficial silica-rich and alkali-rich, but lead-poor dielectric emissive layer 52 about 2–20 nm in thickness (d) that produces adequate secondary emission (i.e., $E_P^I \sim 30$ eV) to achieve useful electron multiplication. Beneath this dielectric emissive layer 52 (or dynode surface), a semiconductive lead-rich layer 54 about 100–1000 nm in thickness (t) serves as an electronically conductive path for discharging the emissive layer 52. Upon consideration of the ranges of $R_S$ for RLSG dynodes given above and assuming the semiconductive layer 54 has a thickness t=100 nm, it can be readily shown that, the bulk electrical resistivity (r) of the material comprising semiconductive layer 54 is $r=R_S.t=10^1-10^3$ Ω.cm for CEM dynodes and $r=10^6-10^9$ Ω.cm for MCP advances A base glass 56 provides mechanical support for the continuous RLSG dynode 50 in the geometry of macroscopic channels for CEMs or arrays of microscopic channels for MCPs. The interface 58 shown schematically in FIG. 3 between the conductive 54 and emissive 52 layers in actuate RLSG dynodes is rather less distinct than illustrated in FIG. 3; this schematic structure, however, does provide a useful model.

While the manufacturing technology of RLSG MCPs and CEMs is mature, relatively inexpensive, and reasonably efficient, it imposes important 1 imitations on cur rent device technology and its future development. These limitations are summarized as follows. Both electrical and electron emissive properties of RLSG dynodes are quite sensitive to the chemical and thermal history of the glass surface comprising the dynode. Therefore, reproducible performance characteristics for RLSG MCPs and CEMs critically depend upon stringent control over complex, time-consuming, and labor-intensive manufacturing operations. In addition, the ability to enhance or tailor the characteristics of RLSG MCPs and CEMs is constrained by the limited choices of materials which are compatible with the present manufacturing technology. Gain stability, maximum operating temperature, background noise, and heat dissipation in high-current devices are several key areas where performance is adversely affected by material limitations of the lead silicate glasses that are used in the manufacture of conventional MCPs and CEMs.

The GMD process also imposes important manufacturing constraints on the geometry, and hence on the performance and applications of RLSG MCPs in the following ways:

- channel diameters ≧4 μm and channel pitches ≧6 μm in current practice limit temporal and spatial resolution;
- quasi-periodic arrays of channels within multifiber regions and gross discontinuities at adjacent multifiber boundaries greatly complicate the task of addressing or reading out individual or small blocks of channels;
- variations in channel diameter from area to area in an array are manifest as patterns with differential gain; and
- the largest size of a microchannel array is now limited to a linear dimension on the order of 10 cm.

U.S. Pat. No. 5,086,248, filed Aug. 18, 1989 concurrently with this application of Horton et al., U.S. Pat. No. 5,086,248 which issued Feb. 4, 1992, Ser. No. 395,596, filed Aug. 18, 1989, which is incorporated herein by reference address these problems. The disclosure of Horton et al. is incorporated herein by reference. The Horton et al. patent discloses how to achieve reduced channel size and pitch less than 10 μm and particularly shows how to achieve channel diameters less than 4 μm and channel-to-channel spacing of less than 6 μm. The present invention allows these small diameter and close pitch devices to be effectively utilized.

Finally, despite the major market for MCPs in military night vision devices, other substantial applications for these remarkable detectors have been slow to evolve in part because they are difficult to interface with solid-state electronics. Greater compatibility with semiconductor electronics (e.g., with regard to materials of construction, interconnection, or power requirements for operation) would facilitate the implementation of important new applications including commercial night vision, optical computing, and high-performance display, photographic, and imaging technologies.

SUMMARY OF THE INVENTION

The invention is directed to continuous dynodes formed by thin film processing techniques. According to one embodiment of the invention, a continuous dynode is disclosed in which at least one layer is formed by reacting a vapor in the presence of a substrate at a temperature and pressure sufficient to result in chemical vapor deposition kinetics dominated by interfacial processes between the vapor and the substrate. In another embodiment the surface of a substrate or surface of a thin film previously deposited on a substrate is subjected to a reactive atmosphere at a temperature and pressure sufficient to result in a reaction modifying the surface. In yet another embodiment a continuous dynode is formed in part by liquid phase deposition of a dynode material onto the substrate from a supersaturated solution. The resulting devices exhibit conductive and emissive properties suitable for electron multiplication in CEM, MCP and MEM applications. In the preferred embodiments, the thin films are conformal with the substrate surfaces and the emissive layer is hermetic.

DESCRIPTION OF THE PREFERRED EMBODIMENT

According to one embodiment of the present invention current carrying (e.g. semiconductive) and dielectric thin films may be vapor deposited along the walls of capillary channels within suitable substrates to yield continuous dynodes which replicate the function of reduced lead silicate glass (RLSG) dynodes. Such devices may be comprised of thin film dynodes that are supported by dielectric or semiconductive substrates in the configuration of CEMs and MCPs. For electrically insulating substrates, deposition of both a current carrying or semiconductive layer and an electron emissive layer would generally be necessary; however, appropriately semiconductive substrates would only require the deposition of an emissive layer.

Figure 4:
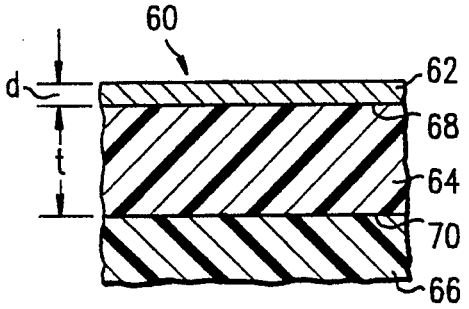
FIG. 4 is a side sectional schematic illustration of a thin film continuous dynode according to one embodiment of the present invention employing a dielectric substrate.

An example of a continuous thin-film dynode 60, according to one embodiment of the present invention, is illustrated in FIG. 4. The dynode 60 comprises an emissive layer or film 62, a semiconductive layer or film 64 and a dielectric substrate 66. The dynode 60 is formed by depositing the semiconductive film such as silicon to a thickness t in the range of 10-1000 nm onto the surface 70 of the substrate 66 such as silica glass. By controlling the concentration of a suitable dopant (e.g., phosphorous) and the morphology of the film, a silicon semiconductive layer 64 with, for instance, $t \simeq 100$ nm can thus be obtained with resistivity $r = 10^1$–$10^3$ Ω.cm yielding $R_S = r/t \simeq 10^6$–$10^8$ Ω/sq for CEM dynodes, or $r = 10^6$–$10^7$ Ω.cm giving $R_S \simeq 10^{11}$–$10^{12}$ Ω/sq for MCP dynodes. Other silicon semiconductive films with higher resistivities in the range of $r = 10^7$–$10^9$ Ω.cm, yielding $R_S = 10^{12}$–$10^{14}$ Ω/sq for MCP dynodes, may be prepared by incorporation of other dopants to form semi-insulating films (e.g., SIPOS).

In a preferred embodiment deposition is achieved by a chemical vapor deposition (CVD) technique. As used and understood herein, the term CVD refers to the formation of thin films under conditions which are generally controlled by interfacial processes between gaseous reactants or reaction products and the substrate rather than by the transport of chemical species through the gas phase near the surface of the substrate.

In the embodiment illustrated in FIG. 4, the emissive layer 62 may comprise a thin layer of $SiO_2$, a native oxide about 2–5 nm in thickness d, overlying the silicon semiconductive layer 64, and be formed by exposure of the semiconductor surface 68 to ambient. Alternatively, the emissive layer 62 of thermal $SiO_2$ and $Si_3N_4$ may be formed or grown to a thickness of 2–20 nm by oxidation or nitriding of the semiconductor surface 68 at elevated temperatures in the presence of reactive gases (e.g., $O_2$ or $NH_3$). As another alternative, an emissive film 62 such as MgO with higher secondary electron yield than thermal $SiO_2$ for electron energies $E_P$ of interest may be deposited by a CVD process to a thickness $d = 2$–$20$ nm upon the surface 68 of semiconductive layer 64 to form the basic two-layer structure of the thin film dynode 60. For thermal $SiO_2$, if $E_P^I \sim 40$ eV and $\delta \sim E_P/E_P^I$, then $0.5 \leqq \delta \leqq 2.5$ for 20 eV $\leqq E_P \leqq$ 100 eV; whereas for MgO, if $E_P^I \sim 25$ eV, then $0.8 \leqq \delta \leqq 4$ for the same range of $E_P$. As an alternative to dielectric emissive layers, semiconductive films with surfaces exhibiting negative electron affinity, and thus highly efficient secondary electron emission, may also be formed by CVD methods (e.g., GaP:Cs—O, GaP:Ba—O, GaAs:Cs—O, InP:Cs—O and Si:Cs—O).

Generally, the thickness t and resistivity r of the semiconductive layer 64 (and therefore sheet resistance $R_S = r/t$) should be uniform along the length of a thin-film dynode 60 to provide a constant electric field in which to accelerate multiplying electrons. Also, the secondary electron yield 6 of the emissive layer 62 should be sufficiently high and spatially uniform to produce adequate signal gain with good multiplication statistics. However, if desired, the layers 62,64 may be formed in radially graded or longitudinally staged CVD applications in order to produce a continuous thin film dynode having graded properties throughout its thickness or incrementally staged properties along its length, respectively. Also, although not always noted in detail, modification of the surface of a bulk semiconductor substrate or a deposited thin film to achieve suitable electron emissive properties may be effected by subsequent oxidation or nitriding.

Substrates for CEMs and MCPs can be either electrically insulating or semiconductive. Insulating substrates 66 (i.e., $r \geqq 10^{12}$ Ω.cm) would generally require deposition of both the electronically semiconductive layer 64 and the electron emissive layer 62 to form the efficient thin-film dynode 60 (FIG. 4).

Figure 5:
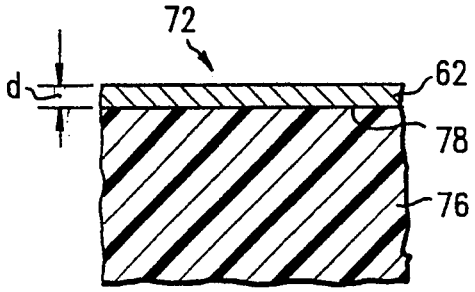
FIG. 5 is a side sectional schematic illustration of a thin film dynode according to another embodiment of the present invention employing a semiconductive substrate.

In contrast, and in accordance with another embodiment of the present invention shown in FIG. 5, the continuous dynode 72 comprises an emissive layer 62 such as MgO deposited on the surface 78 of a suitably semiconductive substrate 76, where $r = 10^4$–$10^7$ Ω.cm for a CEM and $r = 10^8$–$10^{11}$ Ω.cm for an MCP. The bias current for the dynode 72 could be carried throughout the bulk of the substrate 76. Also, as shown in the embodiment illustrated in FIG. 6, a dynode 80 having a somewhat more conductive substrate 82 could be employed by first depositing a dielectric isolation layer 84 (e.g., a film of $SiO_2$ formed by liquid phase deposition from a supersaturated solution) having thickness (z) = 2—5 μm on the substrate 82 prior to formation of the semiconductive 64 and electron emissive 62 layers.

Figure 6:
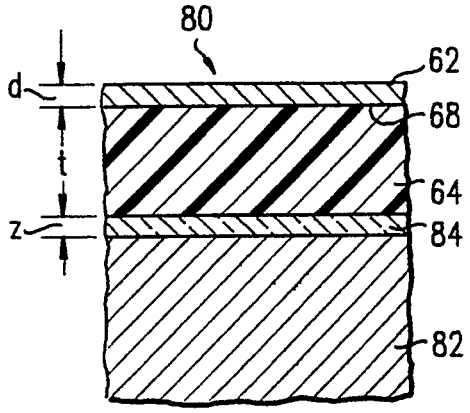
FIG. 6 is a side sectional schematic illustration of a thin film dynode according to another embodiment of the present invention employing a conductive substrate.

Use of insulating 66 or electrically-isolated 82 substrates as in FIGS. 4 and 6 for fabrication of thin film electron multipliers by deposition of conductive and emissive layers is the p,referred embodiment of this invention. Greater flexibility in the selection of electrical properties for a given device and likely better control of such properties during manufacture are major advantages of this approach. However, for certain applications (e.g., reduction of positive ion feedback), the bulk conductive device 72 of FIG. 5 might hold particular attraction.

Figure 1:
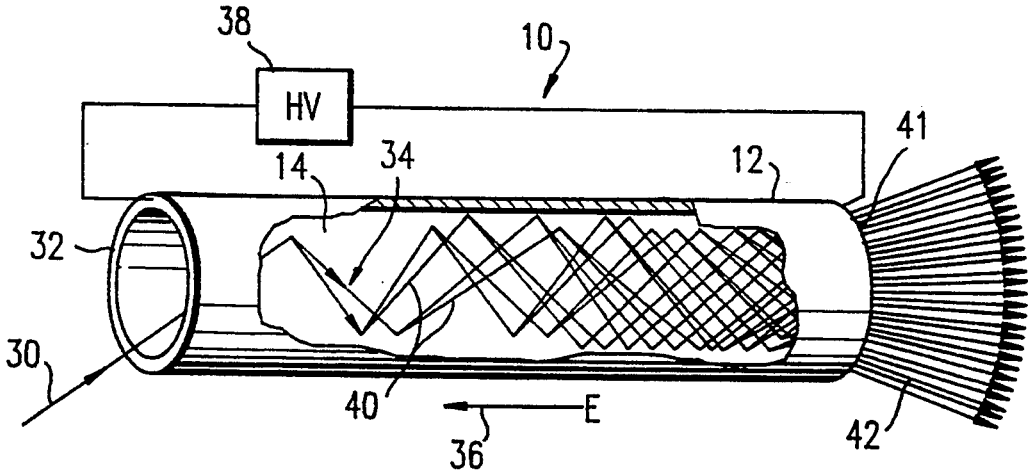
FIG. 1 PRIOR ART
FIG. 1 is a fragmentary schematic illustration perspective of a channel electron multiplier (CEM) according to the prior art.
Figure 2:
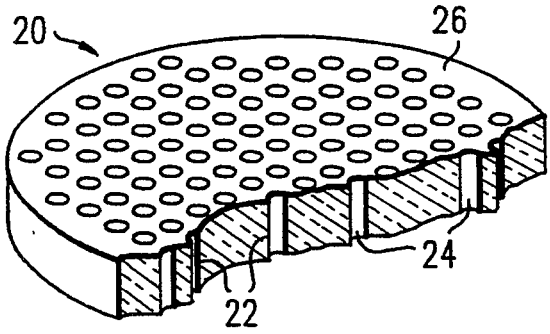
FIG. 2 PRIOR ART
FIG. 2 is a fragmentary schematic illustration in perspective of a microchannel plate (MCP) according to the prior art.
Figure 3:
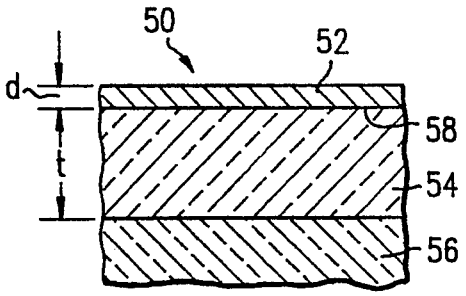
FIG. 3 PRIOR ART
FIG. 3 is a side sectional schematic illustration a reduced lead silicate glass (RLSG) dynode according to the prior art.
Figure 7:
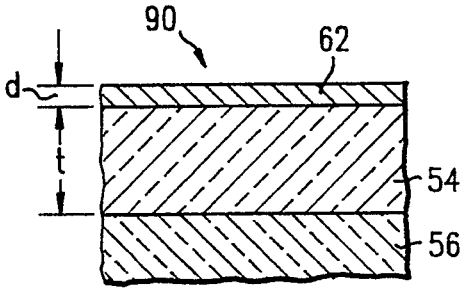
FIG. 7 is a side sectional schematic illustration of a thin film dynode according to another embodiment of the present invention employing a lead silicate glass substrate and RLSG semiconductive layer.

In current manufacturing practice, multicomponent lead silicate glass surfaces are chemically and thermally processed to produce continuous RLSG dynodes with appropriate electrical and secondary emission characteristics (FIG. 3). However, in another embodiment of the present invention, illustrated in FIG. 7 the RLSG dynode 90 is comprised of a dielectric emissive layer 62 and an underlying semiconductive layer 54. This two-layer structure is mechanically supported by the lead silicate base glass 56 in channel geometries which are characteristic of CEMs or MCPs. The emissive layer 62 in contrast to prior RLSG dynodes (FIG. 3) is preferably formed by CVD of an appropriate material such as $Si_3N_4$, MgO, or the like. The semiconductive layer 54 may be formed by $H_2$ reduction under conditions sufficient to promote formation of the semiconductive layer but minimize the formation of emissive layer 52, as in conventional RLSG dynodes (FIG. 3).

Further, when used as an emissive layer 62 in any of the embodiments of FIGS. 4–7, $Si_3N_4$ acts as a hermetic seal to protect the underlying surfaces from environmental degradation thereby enhancing the product shelf life. $Si_3N_4$ and $Al_2O_3$ are also more resistant than $SiO_2$ or $SiO_2$-rich glasses to degradation under electron bombardment thereby extending the operational lifetime of the dynode.

Figure 8:
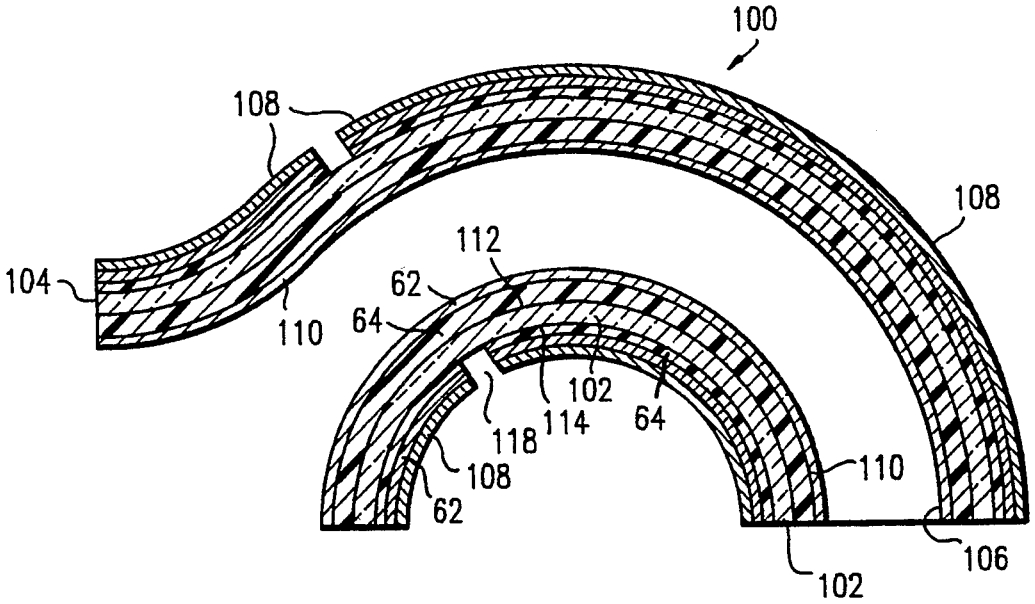
FIG. 8 is a fragmentary schematic side sectional illustration of a curved channel electron multiplier employing a thin film dynode according to the present invention.
Figure 9:
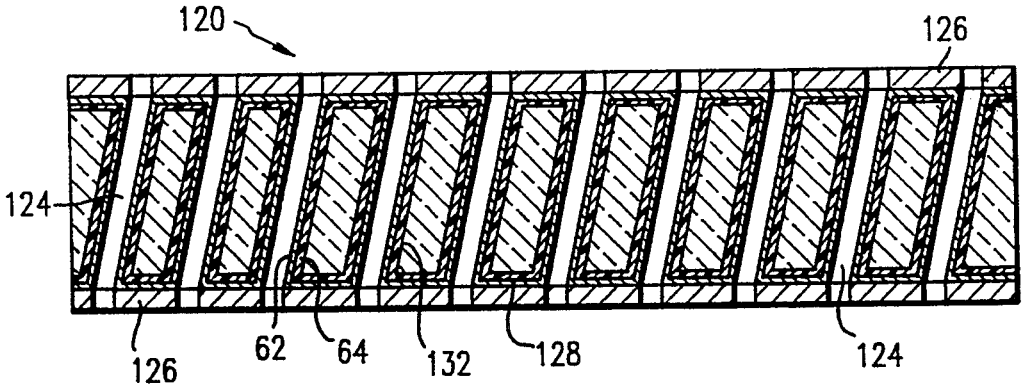
FIG. 9 is a fragmentary schematic side sectional illustration of a microchannel plate employing a thin film dynode according to the present invention.
Figure 10:
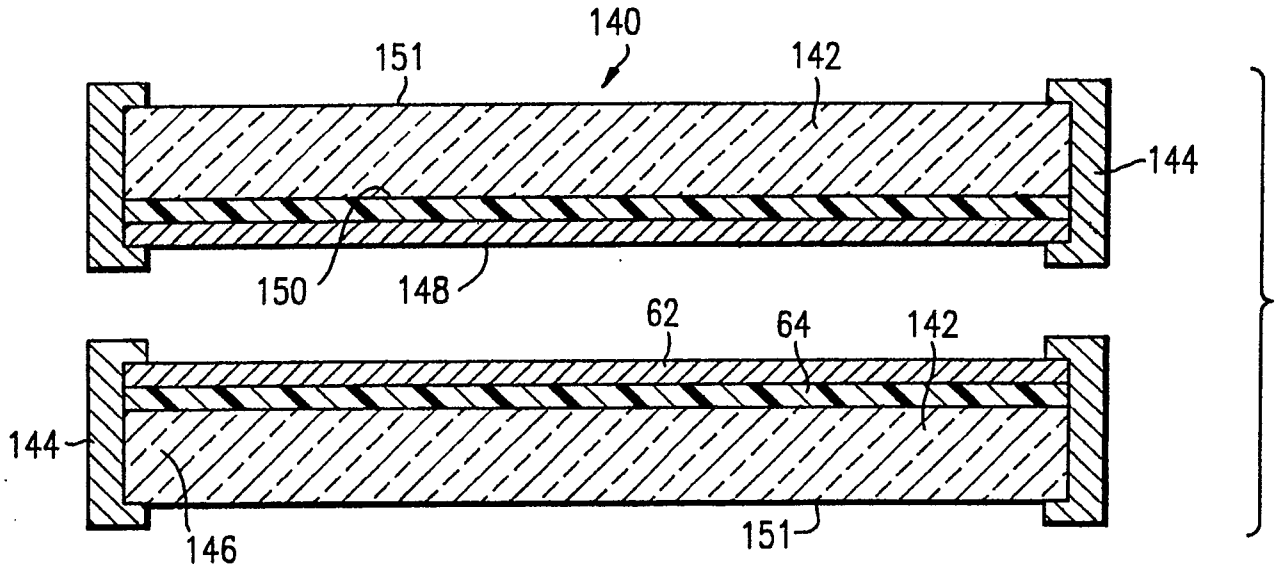
FIG. 10 is a schematic illustration in perspective of a magnetic electron multiplier (MEM) employing a thin-film dynode according to the present invention.

Exemplary devices employing thin film dynodes in accordance with the embodiment of FIG. 4 are illustrated in FIGS. 8–10. It should be understood, however, that any of the aforementioned alternative embodiments of thin film dynodes illustrated in FIGS. 5–7 may also be employed with the exemplary embodiments of FIGS. 8–10. In FIG. 8 a CEM 100 is illustrated which is formed of a curved capillary glass tube 102 having a flared input end 104 and a straight output end 106. If desired, the tube 102 may be formed of a molded and sintered dielectric block of ceramic or glass. Electrodes 108 are formed on the exterior of the tube 102 and thin-film dynode 110 is formed on the interior of the tube as shown. In accordance with the invention the tube 102 is first subjected to a two-stage CVD process whereby the respective exterior and interior surfaces 114 and 112 are successively coated in a reactor (not shown) with a semiconductive layer 64 and emissive layer 62. The exterior of the tube 102 is masked and stripped (e.g., by sandblasting or etching) to produce a nonconductive band 118 on the exterior wall 114. Metal electrodes 108 are thereafter applied by a suitable evaporation procedure. The semiconductive layer 64 and emissive layer 62 in the internal surface 112 functions as the continuous thin film dynode 110.

In FIG. 9 an MCP 120 is illustrated which comprises a dielectric ceramic or glass substrate 122 formed with microchannels 124 and electrodes 126 deposited on the opposite faces 128 of the substrate 122. Thin-film dynodes 130 formed of an emissive layer 62 and a semiconductive layer 64 as hereinbefore described are deposited on the walls 132 of the channels 124. (Portions of the films 62, 64 which coat the substrate 122 elsewhere do not function as a dynode.) The electrodes 126 are deposited atop the films (62,64) on the flat parallel faces 128 of the substrate 122. In accordance with the invention, the MCP 120 may be formed by the GMD process described above or by an anisotropic etching technique described in the above-mentioned patent of Horton et al. referred to above and commonly assigned to the assignee herein.

In FIG. 10 a magnetic electron multiplier (MEM) 140 is illustrated which is formed, in part, by a pair of glass plates 142 or other suitable dielectric substrate having electrodes 144 on the ends 146 and thin-film dynodes 148 on the confronting surfaces 150. The dynode 148 is formed of an emissive layer 62 and a semiconductive layer 64 as hereinbefore described. The electrodes 144 are deposited after stripping the exterior surfaces 151 to remove films (62,64).

The process of forming thin-film continuous dynodes according to the present invention in capillary channels of macroscopic to microscopic dimensions for CEMs and MCPs follows. Chemical vapor deposition (CVD) according to one embodiment of the present invention is a method by which thin solid films of suitable materials (e.g. semiconductors or ceramics) are vapor deposited onto the surface of a substrate by reaction of gaseous precursors. Temperature, pressure, and gaseous reactants are selected and balanced so that the physical structure and electrical and electron emissive properties of the dynodes so produced are appropriate for achieving the performance desired. In thermally-activated CVD processes, the substrate is typically heated to a temperature (T)=300°–1200° C., that is sufficient to promote the deposition reaction; however, such reactions can also be plasma-assisted or photochemically-activated at even lower temperatures. Basic deposition reactions include pyrolysis, hydrolysis, disproportionation, oxidation, reduction, synthesis reactions and combinations of the above. According to the invention, low pressure CVD (LPCVD) occurring preferably at pressures less than 10 torr and more desirably between about 1 and 0.1 torr, results in the formation of a satisfactory continuous thin-film dynode. Generally, LPCVD results in conformal thin films usually having substantially uniform geometrical, electrical and electron emissive properties. The deposition reactions preferably occur heterogeneously at the substrate surface rather than homogeneously in the gas phase. Metal hydrides and halides as well as metalorganics are common vapor precursors.

Physical properties of CVD thin films are a function of both the composition and structure of the deposit. The range of materials that has been produced by CVD methods is quite broad and includes the following: common, noble, and refractory metals (e.g., Al, Au, and W); elemental and compound semiconductors (e.g., Si and GaAs); and ceramics and dielectrics (e.g. , diamond, borides, nitrides, and oxides). Properties of such thin-film materials can be varied significantly by incorporation of suitable dopants, or by control of morphology. The morphology of CVD materials can be single crystalline, polycrystalline, or amorphous depending on the processing conditions and the physicochemical nature of the substrate surface. Also: materials of exceptional purity can be prepared by CVD techniques.

In general, the emissive portion of the dynodes of the present invention may be formed of $SiO_2$, $Al_2O_3$, MgO, $SnO_2$, BaO, $Cs_2O$, $Si_3N_4$, $Si_xO_yN_z$, C (Diamond), BN, and AlN; negative electron affinity emitters GaP:-

Cs—O, GaP:Ba—O, GaAs:Cs—O, InP:Cs—O, and Si:Cs—O. Such materials may be formed from precursors such as $SiH_4$, $SiCl_xH_y$, $Si(OC_2H_5)_4$, β-diketonate compounds of Al (e.g., $Al(C_5HO_2F_6)_3$), $Al(CH_3)_3$, β-diketonate compounds of Mg (e.g. , $Mg(C_5HO_2F_6)_2$), $SnCl_4$, β-diketonate compounds of Ba (e.g., $Ba(C_{11}H_{19}O_2)_2$), $CH_4$, Cs, $B_2H_6$, $Ga(C_2H_5)_3$, $Ga(CH_3)_3$, $PH_3$, $AsH_3$, $In(CH_3)_3$, $O_2$, $N_2O$, NO, $N_2$, and $NH_3$. The current carrying portion of the dynodes according to the present invention may be formed of As-, B-, or P-doped Si, Ge (undoped), Si (undoped), $SiO_x$ (SIPOS), $Si_xN_y$, $Al_xGa_{1-x}As$, and $SnO_x$. Precursors for such materials may be $SiH_4$, $PH_3$, $GeH_4$, $B_2H_6$, $AsH_3$, $SnCl_4$, $Ga(C_2H_5)_3$, $Ga(CH_3)_3$, $Al(CH_3)_3$, $N_2O$, $N_2$, and $NH_3$.

Selected representative examples of semiconductive and dielectric materials and their precursors which are of particular interest for fabrication of thin-film dynodes by CVD methods are given in Tables I and II, respectively. Table I lists representative materials with ranges of electrical resistivity r at 25° C. that, assuming a film thickness of t=100 nm, yield suitable ranges of sheet resistance $R_S$ for the semiconductive layer 64 of a continuous dynode in either a CEM or MCP.

TABLE I

Materials for Semiconductive Layer (t = 100 nm)

| Material | Precursor | r (Ω · cm) | $R_S$ (Ω/sq) | Device |
|---|---|---|---|---|
| Si (P-doped) | $SiH_4$ and $PH_3$ | $10^1$–$10^3$ | $10^6$–$10^8$ | CEM |
| Ge (undoped) | $GeH_4$ | $10^1$–$10^2$ | $10^6$–$10^7$ | CEM |
| Si (undoped) | $SiH_4$ | $10^6$–$10^7$ | $10^{11}$–$10^{12}$ | MCP |
| $SiO_x$ (SIPOS) | $SiH_4$ and $N_2O$ | $10^7$–$10^9$ | $10^{12}$–$10^{14}$ | MCP |
| $Si_xN_y$ | $SiH_4$ and $NH_3$ | $10^6$–$10^9$ | $10^{11}$–$10^{14}$ | MCP |

Table II identifies representative materials for use as the emissive layer 62 with sufficiently low values of $E_P^I$ to produce adequate or high values of secondary electron yield δ in the electron energy range of 20 eV-$\leqq E_P \leqq$100 eV.

TABLE II

Materials for Emissive Layer (20 eV $\leqq E_p \leqq$ 100 eV)

| Material | Precursor | $E_p^I$ (eV) | $\delta = E_p/E_p^I$ |
|---|---|---|---|
| $SiO_2$ glass | $SiH_4$ or $Si(OC_2H_5)_4$ and $O_2$ | ~40 | ~0.5–2.5 |
| $Al_2O_3$ | $Al(CH_3)_3$ or $Al(C_5HO_2F_6)_3$ and $O_2$ | ~25 | ~0.8–4 |
| MgO | $Mg(C_5HO_2F_6)_2$ and $O_2$ | ~25 | ~0.8–4 |
| GaP: Cs—O | $Ga(CH_3)_3$, $PH_3$, Cs, and $O_2$ | ~20 | ~1–5 |

While thermally-activated CVD may be practiced in a reactor (not shown) at atmospheric pressure (APCVD), important advantages are gained by reducing the reactor pressure (P) to the range of about 13 Pa (0.1 torr)$\leqq P \leqq 1.3\times10^3$ Pa (10 torr). When P is decreased from about $1.0\times10^5$ Pa (760 torr) to $1.3\times10^2$ Pa (1 torr), the mean free path of gas molecules at T=600° C. increases a thousandfold from about 0.2 μm to 200 μm. In low pressure, thermally-activated CVD (LPCVD), the resulting higher diffusivities of the reactant and product gasses cause the film growth rate to be controlled by kinetic processes at the gas substrate interface (e.g., adsorption of reactants, surface migration of adatoms, chemical reaction, or desorption of reaction products) rather than by mass transport of the gasses through a stagnant boundary layer adjacent to the interface. By maintaining the surface of a substrate at constant temperature T=300°-1200° C., conformal films can be heterogeneously deposited by LPCVD even over substantial contours because supply of an equal reactant flux to all locations on the substrate is not critical under surface reaction rate-limited conditions. Conformal coverage of films over complex topographies (e.g., along a trench or channel) depends on rapid migration of adatoms prior to reaction. In the case of APCVD, however, lower gas diffusivities promote mass transport-limited conditions where an equal reactant flux to all areas of the substrates is essential for film uniformity.

For this reason, LPCVD is thought to have a greater potential than APCVD for attaining the objective of depositing conformal conductive and emissive layers 64,62 with uniform thicknesses and properties within capillary substrate geometries to form thin-film dynodes for CEMs and MCPs. Also, since LPCVD can provide conformal films without the substrate 66 being in the line-of-sight of the vapor source, it is clearly superior to physical vapor deposition methods (e.g., evaporation and sputtering) for this application. Other noteworthy advantages of LPCVD include better compositional and structural control, lower deposition temperatures, fewer particulates due to homogeneous reactions, and lower processing costs.

As an alternative to thermally-activated LPCVD, plasma-assisted CVD at low pressure (PACVD) is attractive because it offers an even lower range of processing temperatures (T=25°-500° C.) than LPCVD and the considerable potential for synthesizing unusual thin-film materials under non-equilibrium conditions. Photochemically-activated CVD (PCCVD) is another low temperature processing variant of interest.

If a graduation in film thickness along the length of a channel is desired, the pressure may be raised to reduce gas transport and promote nonuniform deposition along the channel axis without departing from the invention. Likewise, staged deposition may be achieved by producing one or more continuous, interconnected thin-film dynode elements, each being uniform over a substantial length. Also, the deposition parameters may be held constant or varied gradually so that, respectively, a single compositionally uniform film is deposited which desirably exhibits both conductive and emissive properties, or the composition and properties of the film or films vary with thickness to achieve some desirable purpose.

Aside from electrical requirements, substrates for CEMs and MCPs should be comprised of materials that are readily formable into the geometries of such devices but also compatible with CVD processing methods. Contemplated deposition temperatures of 300°-1200° C. for LPCVD require a substrate to be sufficiently refractory so that it does not melt or distort during processing. In addition, the substrate should be chemically and mechanically suited to the overlying thin films such that deleterious interfacial reactions and stresses are avoided. Moreover, the substrate should be made of a material with adequate chemical purity such that control over the deposition process and essential properties of the thin-film dynodes are not compromised by contamination effects. Finally, for electron multipliers that operate at a high bias current, substrates with high thermal conductivity (k) would assist the dissipation of Joule heat.

In accordance with the present invention, the substrate may be a material selected from the group consisting of $Si_3N_4$, AlN, $Al_2O_3$, $SiO_2$ glass $R_2O$—$Al_2O_3$—$SiO_2$ (R=Li, Na, K) glasses, $R_2O$—BaO—$Bi_2O_3$—PbO—$SiO_2$ (R=Na, K, Rb, Cs) glasses, AlAs, GaAs, InP, GaP, Si, Si with a $SiO_2$ isolation layer, and GaAs or InP with a $Si_3N_4$ isolation layer.

Selected representative examples of refractory, high purity materials suitable for substrates 66,76,82 are given in Table III with nominal values of bulk electrical resistivity r and thermal conductivity k at 25° C.

TABLE III

Substrate Materials

| Material | r (Ω · cm) | k (W/m— °K.) | Device (Substrate) |
|---|---|---|---|
| AlN | $>10^{14}$ | >150 | CEM (66) and MCP (66) |
| $Al_2O_3$ | $>10^{14}$ | 20 | CEM (66) and MCP (66) |
| $SiO_2$ glass | $>10^{14}$ | 1 | CEM (66) and MCP (66) |
| Si (undoped) with $SiO_2$ isolation layer | $>10^{12}$ | — | MCP (82) |
| GaP (undoped) | $>10^{10}$ | — | MCP (76) |
| GaAs (undoped) | $\sim 10^{8}$ | 46 | MCP (76) |
| Si (undoped) | $\sim 10^{5}$ | 150 | CEM (76) |

A dielectric substrate for a CEM can be produced, for instance, by thermal working of fused quartz glass or by injection molding and sintering of ceramic powders of or AlN. The use of lithographic methods and etching with a flux of reactive particles to create an array anisotropically etched hollow channels in wafer-like substrates of materials such as $SiO_2$, Si, or GaAs for MCPs is also possible as described in Horton et al. noted above.

According to the invention, vapor deposition methods based on CVD can be used to fabricate continuous thin-film dynodes with electrical and electron emissive properties that are comparable to those obtained with conventional RLSG dynodes. Because of this, more efficient manufacturing procedures for CEMs and MCPs are available, including improvements in RLSG configurations. Further, it is expected that significant improvements in the performance of CEMs and MCPs made in accordance with the teachings of the present invention can be achieved by capitalizing on the ability to tailor the materials and structure of thin-film dynodes.

The advantages which may be achievable include better multiplication statistics and operation at a lower external bias potential $V_B$ by deposition of an emissive layer 62 with higher secondary electron yield 6 than conventional RLSG dynodes (e.g., MgO or negative electron affinity emitters such as GaP:Cs—O). Better gain stability and longer operational lifetimes (e.g., $\geqq 100$ C/cm$^2$ of extracted charge) are achievable by use of an emissive layer 62 such as $Si_3N_4$ or $Al_2O_3$ which exhibits low susceptibility to outgassing or degradation by electron irradiation. Improved noise characteristics and extended dynamic range result from choice of high-purity materials for dynodes and substrates which are free of radioactive impurities, a major source of background noise. Maximum operating temperatures approaching 500° C. are achieved by use of suitably refractory materials for dynodes and substrates. Environmental stability is enhanced by application of an emissive layer 62 (e.g., $Si_3N_4$) that can also function as a hermetic seal for environmentally sensitive dynode materials such as RLSG. Very importantly, the current transfer characteristics for specific applications may be optimized by exercising control over the physical dimensions, composition and morphology, and hence the electrical and electron emissive properties of the films 62,64.

Thin-film processing according to the present invention includes treatment of the surfaces of semiconductive films or surfaces of bulk semiconductive substrate materials to achieve desirable electron emissivity. In embodiments referred to in FIGS. 4 and 6 the surface 68 of a semiconductive layer 64 such as silicon may be oxidized (or nitrided) at 300°-1200° C. in $O_2$ (or $NH_3$) to produce an emissive layer 62 of thermal $SiO_2$ (or $Si_3N_4$) with thickness d=2-20 nm. In FIG. 5 a bulk semiconductor 76 such as silicon may be treated in a similar manner to produce an emissive surface. Also, dielectric films such as $SiO_2$ may be formed by liquid phase deposition (LPD) to form the emissive layer 62 or the isolation layer 84 in the embodiments of FIGS. 4-7. Using LPD, for instance, $SiO_2$ films can be deposited at 25°-50° C. onto the interior surfaces of macroscopic or microscopic capillary channels of CEMs or MCPs from a supersaturated aqueous solution of $H_2SiF_6$ and $SiO_2$ with a small addition of $H_3BO_3$. The above processes may be combined with other processes herein described to produce various continuous thin-film dynode configurations.

Examples which describe fabrication and performance of CEM and MEM devices prepared in accordance with the present invention are set forth below.

Example I

Fused quartz capillary tubes (1 mm ID×3 mm OD) with one end flared into an input cone, similar to the tube 102 illustrated in FIG. 8, were employed as substrates to make sets of straight-channel CEMs with $\alpha$=L/D=20, 30, and 40, and curved-channel CEMs with $\beta$=L/S=1.2.

The substrates were first cleaned by a standard procedure and then placed inside a hot-wall, horizontal-tube, LPCVD reactor for deposition of silicon thin films. Amorphous undoped silicon films were formed on one set of substrates by reaction of $SiH_4$ at P=26-52 Pa (0.2—0.4 torr) and T=540°-560° C. In a separate experiment, amorphous P-doped silicon films were formed on another set of substrates by reaction of $PH_3$ and $SiH_4$ in a reactant ratio of $PH_3/SiH_4=5\times10^{-4}$ under otherwise similar conditions. Semiconductive films 64 of thickness t≃300 nm were thus deposited on surfaces 112,114 of capillary substrates 102 (FIG. 8) at a rate of 1-10 nm/min.

After deposition of the silicon films, the capillary substrates were allowed to cool in the reactor and then were assembled into CEMs 100 as follows. Electrical continuity along the outer surface 114 of the capillary tubes was broken by removing the silicon deposit within a narrow band 118 around this outer surface (FIG. 8). Nichrome electrodes 108 were then vacuum-evaporated onto the ends of each tube without coating the non-conductive band between them. Each CEM was completed by attaching electrical leads to both electrodes.

Measurements of electrical resistance down the bore of the straight-channel CEMs showed that the undoped and P-doped silicon films had sheet resistances $R_S \simeq 10^{11}$ $\Omega$/sq and $\simeq 10^8$ $\Omega$/sq, respectively. In both cases, $R_S$ was independent of channel geometry for $20 \leqq \alpha \leqq 40$. These results indicate that both the thickness and resistivity of each film, as prepared by LPCVD methods, are substantially uniform along the length of capillary channels with aspect ratios sufficient to support useful electron multiplication.

Figure 11:
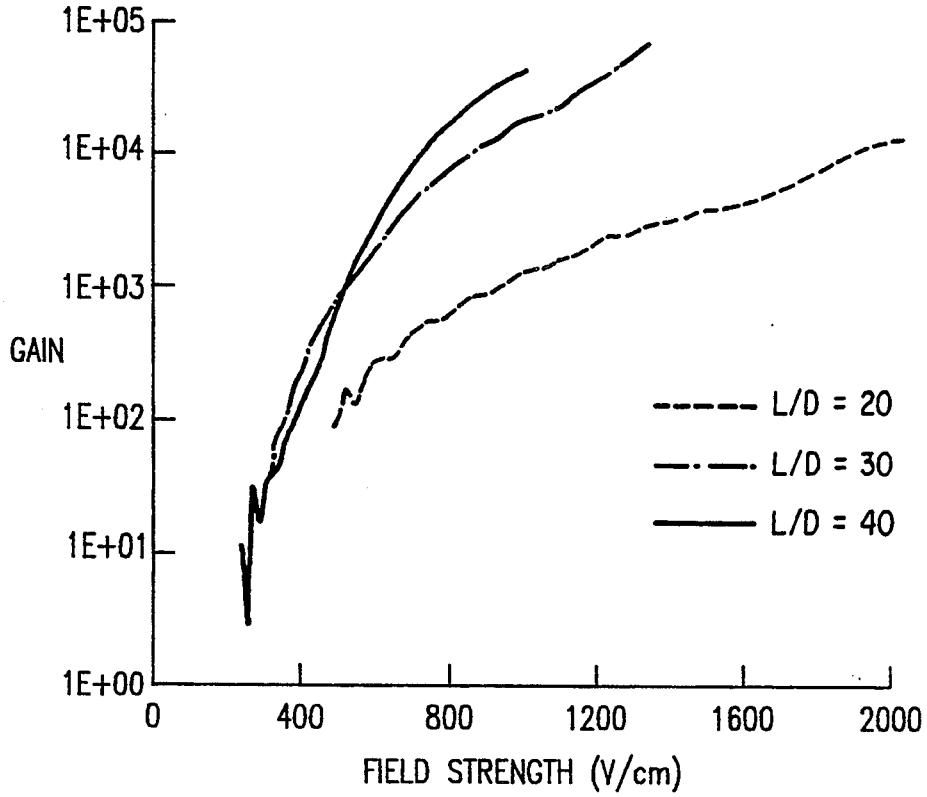
FIGS. 11 is a plot of signal gain verses electric field strength for exemplary straight-channel electron multipliers with different aspect ratios employing a thin-film dynode according to the present invention.

Methods for characterizing the gain G of electron multipliers in analog and pulse counting modes are known. Plots of analog gain $G = I_o/I_i$ versus electric field strength $\epsilon$ applied to straight-channel CEMs 100 having $\alpha = 20$, 30, and 40 with $R_S \simeq 10^8$ $\Omega$/sq for input currents $I_i = 1$ pA are presented in FIG. 11. While unsaturated gains $G \geqq 10^4$ were obtained for each CEM, one also sees the G increases with $\alpha$ at sufficiently large vales of $\epsilon$.

Figure 12:
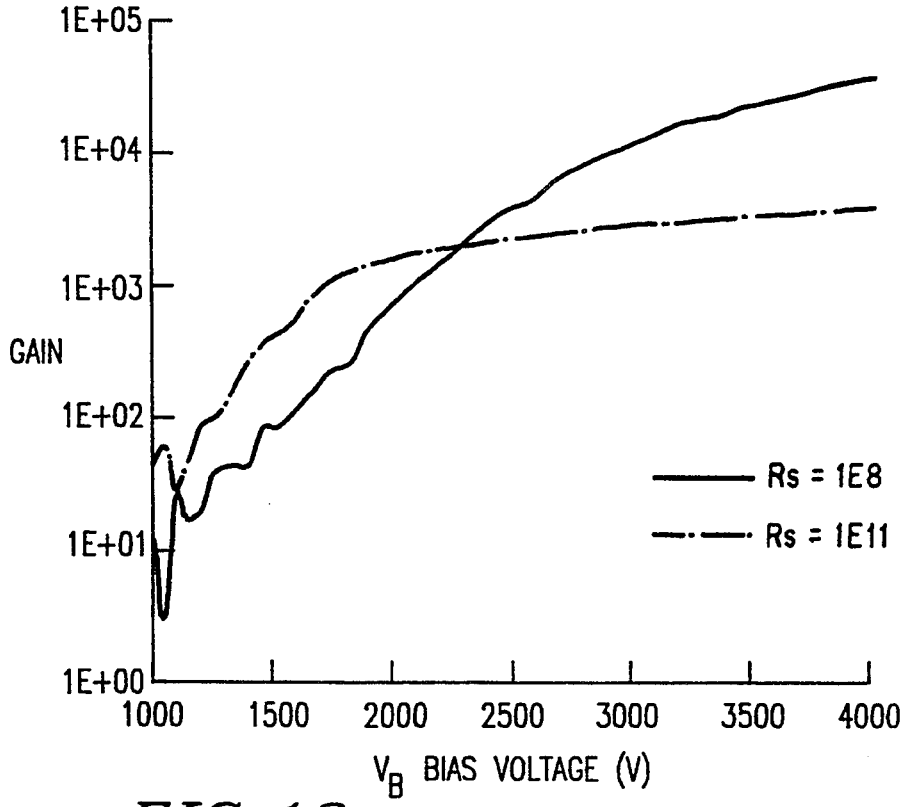
FIG. 12 is a plot of signal gain verses bias voltage for exemplary straight-channel electron multipliers of different electrical resistance employing a thin-film dynode according to the present invention.

Graphs of analog gain $G = I_o/I_i$ versus bias voltage $V_B$ for straight-channel CEMs 100 having $R_S \simeq 10^{11}$ $\Omega$/sq and $\simeq 10^8$ $\Omega$/sq with $\alpha = 40$ for $I_i = 1$ pA are given in FIG. 12. The CEM with higher $R_S$ shows a saturated gain $G = 10^3$–$10^4$ and is limited by the relatively low bias current $i_B$ that is carried in the semiconductive layer. In contrast, the CEM with lower $R_S$ exhibits an unsaturated gain $G > 10^4$.

Figure 13:
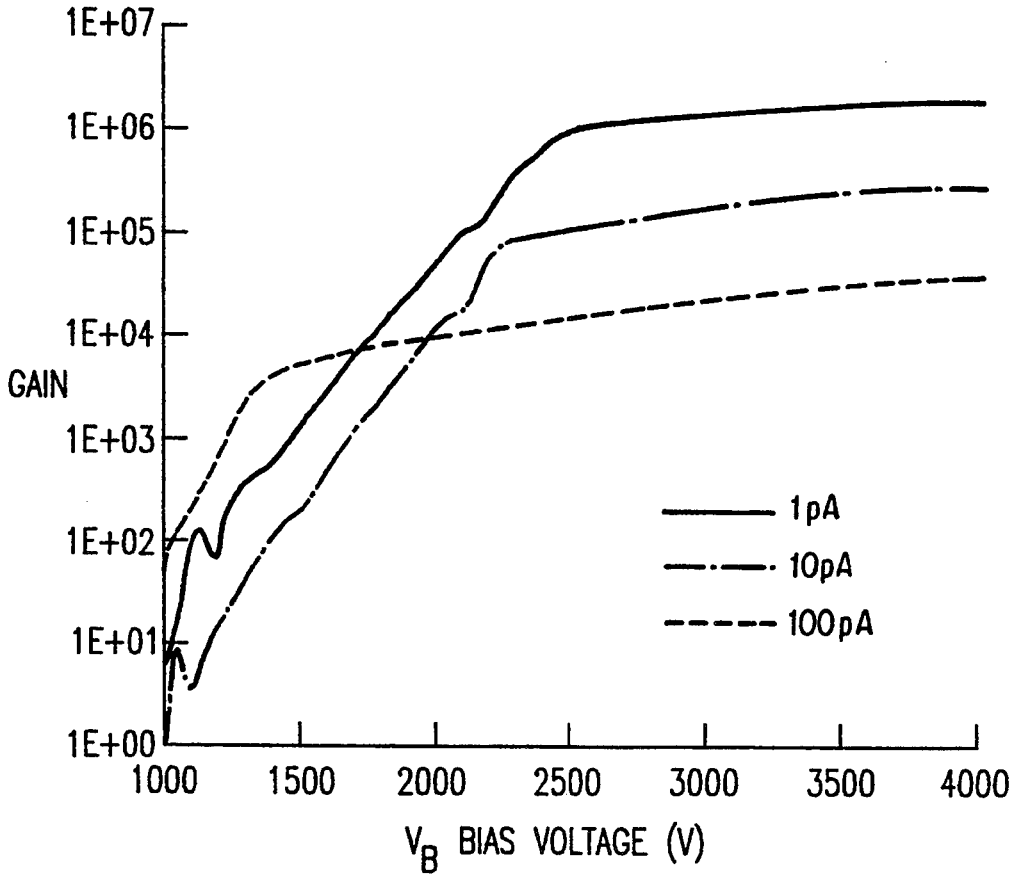
FIG. 13 is a plot of signal gain verses bias voltage at different input current levels for an exemplary curved-channel electron multiplier employing a thin-film dynode according to the present invention.

FIG. 13 displays plots of analog gain $G = I_o/I_i$ versus voltage for a curved-channel CEM 100 with $\beta = 1.2$ and $R_S = 10^8$ $\Omega$/sq for several values of $I_i = 1$, 10, and 100 pA. Saturated gains are observed at all input levels $I_i$. In particular, the roughly order of magnitude decreases in saturated gain with corresponding increases in $I_i$ clearly indicate a current-limited multiplier response. For $I_i = 1$ pA, this CEM shows a maximum gain $G > 10^6$.

Example II

Fused quartz plates (25×60×1 mm) similar to the plates 142 that are illustrated in FIG. 10, were used as substrates to form thin-film dynodes for a MEM 140. Amorphous P-doped silicon films with $t \simeq 300$ nm $R_S \simeq 10^8$ $\Omega$/sq were formed on the planar substrates 142 using methods and conditions similar to those described in Example I for the CEMs.

The MEM was assembled as follows. The silicon deposit was removed from one flat surface 151. A pattern of nichrome electrodes was then deposited through a mask (not shown) onto the other side of each plate 142 with the silicon deposit 148. A set of two plates 142 with closely matched $R_S$ were used as field and dynode strips to construct the MEM 140.

Figure 14:
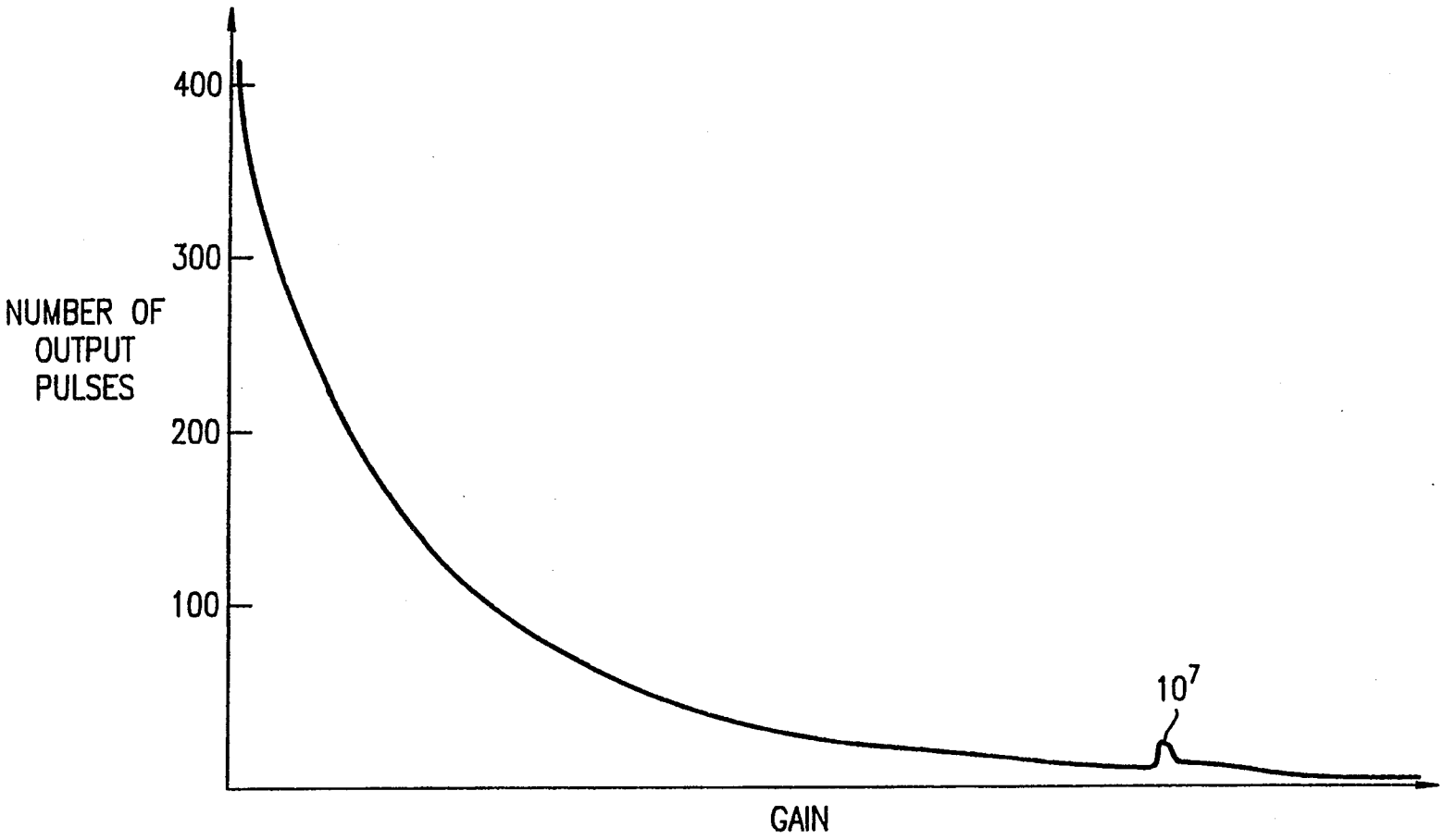
FIG. 14 is a plot of the pulse height distribution of a magnetic electron multiplier employing a thin-film dynode of the present invention.

Pulse counting measurements on the MEM 140 yielded the pulse height distribution given in FIG. 14. The distribution shown represents the number of output pulses as a function of gain, relative to a calibration line of $G = 10^7$. When operated at a bias voltage $V_B = 2500$ V, the MEM 140 exhibited a negative exponential pulse height distribution with a maximum gain in the range of $10^6$–$10^7$.

The structure of the thin-film dynodes in the above described CEMs 100 and MEM 140 of Examples I and II approximates the embodiment depicted in FIG. 4. A native oxide of $SiO_2$ with thickness d = 2–5 nm serves as the emissive layer 62 and overlies a silicon semiconductive layer 64, which are both supported by a fused quartz substrate 66. The feasibility of such thin film dynodes to support practical levels of electron multiplication has clearly been established by the foregoing Examples. Further, the ability to tailor the current transfer characteristics of an electron multiplier by adjusting the current-carrying properties of a thin-film dynode has been demonstrated. Also, the formation and control of semiconductive films 64 with electrical properties which are suitable for single-channel devices (e.g., P-doped silicon with $R_S \simeq 10^8$ $\Omega$/sq) as well as for multi-channel ones (e.g., undoped silicon with $R_S \simeq 10^{11}$ $\Omega$/sq) have been shown. Finally, one notes that while the signal gains of thin-film devices in Examples I and II approach those of comparable RLSG devices, the performance of the former could be improved by forming a somewhat thicker emissive layer 62 by thermal oxidation or nitriding reactions or by depositing an emissive layer 62 such as MgO with better secondary electron emission characteristics than native $SiO_2$.

While the invention has been described in connection with specific embodiments thereof, it will be understood that it is capable of further modifications. This application is intended to cover any variations, uses or adaptations of the invention following, in general, the principles of the invention, and including such departures from the present disclosure as come within known and customary practice within the art to which the invention pertains.

TABLE I

Materials for Semiconductive Layer (t = 100 nm)

| Material | Precursor | r ($\Omega \cdot$ cm) | $R_5$ ($\Omega$/sq) | Device |
|---|---|---|---|---|
| Si (P-doped) | $SiH_4$ and $PH_3$ | $10^1$–$10^3$ | $10^6$–$10^8$ | CEM |
| Ge (undoped) | $GeH_4$ | $10^1$–$10^2$ | $10^6$–$10^7$ | CEM |
| Si (undoped) | $SiH_4$ | $10^6$–$10^7$ | $10^{11}$–$10^{12}$ | MCP |
| $SiO_x$ (SIPOS) | $SiH_4$ and $N_2O$ | $10^7$–$10^9$ | $10^{12}$–$10^{14}$ | MCP |
| $Si_xN_y$ | $SiH_4$ and $NH_3$ | $10^6$–$10^9$ | $10^{11}$–$10^{14}$ | MCP |

TABLE II

Materials for Emissive Layer (20 eV $\leqq E_p \leqq$ 100 eV)

| Material | Precursor | $E_p^I$ (eV) | $\delta = E_p/E_p^I$ |
|---|---|---|---|
| $SiO_2$ glass | $SiH_4$ or $Si(OC_2H_5)_4$ and $O_2$ | ~40 | ~0.5–2.5 |
| $Al_2O_3$ | $Al(CH_3)_3$ or $Al(C_5HO_2F_6)_3$ and $O_2$ | ~25 | ~0.8–4 |
| MgO | $Mg(C_5HO_2F_6)_3$ and $O_2$ | ~25 | ~0.8–4 |
| GaP: Cs—O | $Ga(CH_3)_3$, $PH_3$, Cs, and $O_2$ | ~20 | ~1–5 |

TABLE III

Substrate Materials

| Material | r ($\Omega \cdot$ cm) | k (W/m— °K.) | Device (Substrate) |
|---|---|---|---|
| AlN | $>10^{14}$ | >150 | CEM (66) and MCP (66) |
| $Al_2O_3$ | $>10^{14}$ | 20 | CEM (66) and MCP (66) |
| $SiO_2$ glass | $>10^{14}$ | 1 | CEM (66) and MCP (66) |
| Si (undoped) with $SiO_2$ isolation layer | $>10^{12}$ | — | MCP (82) |
| GaP (undoped) | $>10^{10}$ | — | MCP (76) |
| GaAs (undoped) | $\sim 10^8$ | 46 | MCP (76) |
| Si (undoped) | $\sim 10^5$ | 150 | CEM (76) |

What is claimed is:

1. A continuous thin firm dynode for replicating the function of reduced lead silicate glass (RLSG) dynodes in an electron multiplier comprising:

a substrate formed with at least one capillary channel therein having a channel wall;

an isolation layer overlying the channel wall; and at least one thin film overlying the isolation layer;

said at least one thin film having a current carrying portion and an electron emissive portion overlying the current carrying portion, said current carrying portion having a resistance capable of carrying a current adequate to replace emitted electrons and establishing an accelerating electric field for said emitted electrons, and said emissive portion having a secondary electron yield capable of resulting in electron multiplication, said electron emissive portion being essentially free of a material which is silica-rich, alkali-rich and lead-poor, and said current carrying portion being essentially free of a material which is lead-rich so as to exhibit resistance to radiolytic damage caused by electron bombardment greater than RLSG, for extending the operational lifetime of said dynode.

2. The continuous dynode of claim 1 wherein the substrate comprises a material selected from the group consisting of $Si_3N_4$, AlN, $Al_2O_3$, $SiO_2$ glass, $R_2O$—$Al_2O_3$—$SiO_2$ (R=Li, Na, K) glasses, $R_2O$—BaO—$Bi_2O_3$—PbO—$SiO_2$ (R=Na, K, Rb, Cs) glasses, AlAs, GaAs, InP, GaP, and Si.

3. The dynode of claim 1 wherein the emissive portion comprises a thin film of one or more materials selected from the group consisting of $SiO_2$, $Al_2O_3$, MgO, $SnO_2$, $Si_3N_4$, $Si_xO_yN_z$, C (Diamond), and BN.

4. The dynode of claim 1 wherein the electron multiplier comprises a microchannel plate having a plurality of capillary channels each having a major transverse dimension on the order of less than about 10 μm and being closely spaced on the order of less than about 10 μm.

5. The dynode of claim 1 wherein the current carrying portion comprises a thin film of a material selected from the group consisting of As-, B-, or P-doped Si, Ge (undoped), S (undoped), $SiO_x$ (SIPOS), $Si_xN_y$, $Al_xGa_{1-x}As$, and $SnO_x$.

6. The dynode of claim 1 wherein the at least one thin film comprises a laminar composite of an electron emissive film overlying a current carrying film.

7. The dynode of claim 1 wherein the isolation layer comprises a dielectric thin film for electrically isolating the at least one thin film from the substrate.

8. The dynode of claim 7 wherein the isolation layer is formed of material selected from the group consisting of $SiO_2$ and $Si_3N_4$.

9. The dynode of claim 7 wherein the at least one thin film comprises a laminar composite of an electron emissive film overlying a current carrying film, overlying the dielectric isolation layer, overlying the substrate, and wherein said substrate is electrically conductive.

10. A continuous thin-film dynode for replicating the function of reduced lead silicate glass (RLSG) dynodes in an electron multiplier comprising:

a substrate formed with at least on capillary channel therein having a channel wall;

an isolation layer overlying the channel wall; and at least one thin film overlying the isolation layer, said at least one thin film having a current carrying portion and an electron emissive portion overlying the current carrying portion, said current carrying portion having a resistance capable carrying a current adequate to replace emitted electrons and establishing an accelerating electric field for said emitted electrons, and said emissive portion having a secondary electron yield capable of resulting in electron multiplication, said electron emissive portion being essentially free of a material which is silica-rich, alkali-rich and lead-poor, and said current carrying portion being essentially free of a material which is lead-rich material so as to exhibit a susceptibility to out gassing in vacuum less than RLSG, for providing a corresponding improvement in gain stability to said dynode.

11. The continuous dynode of claim 10 wherein the substrate comprises a material selected from the group consisting of $Si_3N_4$, AlN, $Al_2O_3$, $SiO_2$ glass, $R_2O$—$Al_2O_3$—$SiO_2$ (R=Li, Na, K) glasses, $R_2O$— BaO—$Bi_2O_3$—PbO—$SiO_2$ (R=Na, K, Rb, Cs) glasses, AlAs, GaAs, InP, GaP, and Si.

12. The dynode of claim 10 wherein the emissive portion comprises a thin film of one or more materials selected from the group consisting of $SiO_2$, $Al_2O_3$, MgO, $SnO_2$, $Si_3N_4$, $Si_xO_yN_z$, C (Diamond), and BN.

13. The dynode of claim 10 wherein the current carrying portion comprises a thin film of a material selected from the group consisting of As-, B-, or P-doped Si, Ge (undoped), Si (undoped), $SiO_x$ (SIPOS), $Si_xN_y$, $Al_xGa_{1-x}As$, and $SnO_x$.

14. The dynode of claim 10 wherein the at least one thin film comprises a laminar composite of an electron emissive film overlying a current carrying film.

15. The dynode of claim 10 wherein the isolation layer comprises a dielectric thin film for electrically isolating the at least one thin film from the substrate.

16. The dynode of claim 15 wherein the isolation layer is formed of material selected from the group consisting of $SiO_2$ and $Si_3N_4$.

17. The dynode of claim 15 wherein the at least one thin film comprises a laminar composite of an electron emissive film overlying a current carrying film, overlying the dielectric isolation layer, overlying the substrate, and wherein said substrate is electrically conductive.

18. A continuous thin-film dynode for replicating the function of reduced lead silicate glass (RLSG) dynodes in an electron multiplier comprising:

a substrate formed with at least one capillary channel therein having a channel wall;

an isolation layer overlying the channel wall; and at least one thin film overlying the isolation layer;

said at least one thin film having a current carrying portion and an electron emissive portion overlying the current carrying portion, said current carrying portion having a resistance capable of carrying a current adequate to replace emitted electrons and establishing an accelerating electric field for said emitted electrons, said electron emissive portion having a secondary electron yield capable of resulting in electron multiplication, and said electron emissive portion being essentially free of a material which is silica-rich, alkali-rich and lead-poor material and said current carrying portion being essentially free of a material which is lead-rich so as to produce a hermetic seal that is more protective than RLSG, for proving a corresponding increase environmental stability to said dynode.

19. The continuous dynode of claim 10 wherein the substrate comprises a material selected from the group consisting of $Si_3N_4$, AlN, $Al_2O_3$, $SiO_2$ glass, $R_2O$—$Al_2O_3$—$SiO_2$ (R=Li, Na, K) glasses, $R_2O$—BaO—$Bi_2O_3$—PbO—$SiO_2$ (R=Na, K, Rb, Cs) glasses, AlAs, GaAs, InP, GaP, and Si.

20. The dynode of claim 18 wherein the emissive portion comprises a thin film of one or more materials selected from the group consisting of $SiO_2$, $Al_2O_3$, MgO, $SnO_2$, $Si_3N_4$, $Si_xO_yN_z$, C (Diamond), and BN.

21. The dynode of claim 18 wherein the current carrying portion comprises a thin film of a material selected from the group consisting of As-, B-, or P-doped Si, Ge (undoped), Si (undoped), $SiO_x$ (SIPOS), $Si_xN_y$, $Al_xGa_{1-x}As$, and $SnO_x$.

22. The dynode of claim 18 wherein the at least one thin film comprises a laminar composite of an electron emissive film overlying a current carrying film.

23. The dynode of claim 18 wherein the isolation layer comprises a dielectric thin film for electrically isolating the at least one thin film from the substrate.

24. The dynode of claim 23 wherein the isolation layer is formed of material selected from the group consisting of $SiO_2$ and $Si_3N_4$.

25. The dynode of claim 23 wherein the at least one thin film comprises a laminar composite of an electron emissive film overlying a current carrying film, overlying the dielectric isolation layer, overlying the substrate, and wherein said substrate is electrically conductive.

26. A continuous thin-film dynode for replicating the function of reduced lead silicate glass (RLSG) dynodes in an electron multiplier comprising:

a substrate formed with at least one capillary channel therein having a channel wall;

an isolation layer overlying the channel wall; and at least one thin film overlying the isolation layer, said at least one thin film having a current carrying portion and an electron emissive portion overlying the current carrying portion, said current carrying portion having a resistance capable of carrying a current adequate to replace emitted electrons and establishing an accelerating electric field for said emitted electrons, and said emissive portion having a secondary electron yield capable of resulting in electron multiplication, said at least one thin film being substantially free of radioactive materials and said electron emissive portion being essentially free of a material which is silica-rich, alkali-rich and lead-poor, and said current carrying portion being essentially free of a material which is lead-rich and having a corresponding dynamic range greater than RLSG dynodes.

27. A continuous dynode for an electron multiplier comprising:

an electrically semiconductive substrate formed with at least one capillary channel therein having a channel wail;

a dielectric isolation layer overlying the channel wall; and at least one thin film overlying the isolation layer, said at least one thin film having a current carrying portion and an electron emissive portion overlying the current carrying portion, said dielectric isolation layer for electrically isolating the at least one thin film from the substrate, said current carrying portion having a resonance capable of carrying a current adequate to replace emitted electrons and establishing an accelerating electric field for said emitted electrons, and said emissive portion having a secondary electron yield capable of resulting in electron multiplication.

28. The dynode of claim 27 wherein the isolation layer is formed of material selected from the group consisting of $SiO_2$ and $Si_3N_4$.

29. The dynode of claim 27 wherein the at least one thin film comprises a laminar composite of an electron emissive film overlying a current carrying film, overlying the dielectric isolation layer, overlying the substrate.

30. The dynode of claim 27 wherein the electron multiplier comprises a microchannel plate having a plurality of capillary channels each channel having a major transverse dimension on the order of less than about 4 μm and being closely spaced on the order of less than about 6 μm.

31. The dynode of 27 wherein the electron multiplier comprises a microchannel plate having a plurality of capillary channels each having a major transverse dimension on the order of less than about 10 μm and being closely spaced on the order of less than about 10 μm.

32. The dynode of claim 27 wherein the emissive portion comprises a thin film of one or more materials selected from the group consisting of $SiO_2$, $Al_2O_3$, MgO, $SnO_2$, $Si_3N_4$, $Si_xO_yN_z$, C (Diamond), and BN.

33. The dynode of claim 27 wherein the current carrying portion comprises a thin film of a material selected from the group consisting of As-, B- or P-doped Si, Ge (undoped), Si (undoped), $SiO_x$ (SIPOS), $Si_xN_y$, $Al_xGa_{1-x}As$, and $SnO_x$.

34. The dynode of claim 27, wherein the substrate comprises a material selected from the group consisting of GaAs, InP and Si.

35. The dynode of claim 27, wherein the isolation layer is a thin film having a thickness in a range of about 2 μm and about 5 μm.

36. The dynode of claims 27 wherein the emissive portion is a thin film having a thickness of 2–20 nm.

37. The dynode of claim 27 wherein the current carrion portion comprises a thin film having a thickness of about 10–1000 nm.

* * * * *